United States Patent [19]

Kamei et al.

[11] Patent Number: 4,995,364

[45] Date of Patent: Feb. 26, 1991

[54] THROTTLE CONTROL APPARATUS FOR ENGINES

[75] Inventors: Eiichi Kamei, Nagoya; Hideaki Namba, Obu; Masahiro Ohba, Okazaki; Shinichiro Tanaka, Mishima; Keiji Aoki, Susono, all of Japan

[73] Assignees: Nippondenso Co., Ltd., Kariya; Toyota Jidosha Kabushiki Kaisha, Toyota, both of Japan

[21] Appl. No.: 463,035

[22] Filed: Jan. 10, 1990

[30] Foreign Application Priority Data

Jan. 18, 1989 [JP] Japan ..... 1-010234

[51] Int. Cl.[5] ..... F02M 7/00

[52] U.S. Cl. ..... 123/442; 123/478

[58] Field of Search ..... 123/442, 478, 438, 399, 123/439, 492; 180/197

[56] References Cited

U.S. PATENT DOCUMENTS

| | | | |
|---|---|---|---|
| 4,391,249 | 7/1983 | Bianchi et al. | 123/438 |
| 4,484,551 | 11/1984 | Choma et al. | 123/442 |
| 4,603,675 | 8/1986 | Junginger et al. | 123/478 |
| 4,638,778 | 1/1987 | Kamei et al. | 123/339 |
| 4,653,449 | 3/1987 | Kamei et al. | 123/478 |
| 4,744,511 | 5/1988 | Kakehi et al. | 239/13 |
| 4,768,486 | 9/1988 | Koike et al. | 123/442 |
| 4,771,848 | 9/1988 | Namba et al. | 180/197 |
| 4,892,076 | 1/1990 | Toshimito et al. | 123/442 |

FOREIGN PATENT DOCUMENTS

| | | |
|---|---|---|
| 59-153945 | 9/1984 | Japan . |
| 62-91644 | 4/1987 | Japan . |
| 63-41636 | 1/1988 | Japan . |

OTHER PUBLICATIONS

G. F. Franklin and J. D. Powell, "Digital Control of Dynamic Systems", pp. 131–139, 1980 (no month provided).

M. K. Liubakka, G. Rizzoni, W. B. Ribbens and K. A. Marko, "Failure Detection Algorithms Applied to Control System Design for Improved Diagnostics and Reliability", (SAE Technical Paper Series) Feb. 29–Mar. 4, 1988, pp. 1–7.

C. D. De Benito and S. J. Eckert, "Control of an Active Suspension System Subject to Random Component Failures", (The American Society of Mechanical Engineers) Nov. 27–Dec. 2, 1988, pp. 1–7.

H. Kwakernaak and R. Sivan, "Linear Optical Control Systems", pp. 198–201 and 522–536, 1972 (no month provided).

*Primary Examiner*—Raymond A. Nelli

*Attorney, Agent, or Firm*—Cushman, Darby & Cushman

[57] ABSTRACT

A throttle control apparatus for engines comprises two throttle actuators for driving two corresponding main and sub throttle valves mounted in series in an intake pipe of an engine. An observer, to which the modern control theory is applied, presumes an opening degree of the main throttle valve in a normal condition, which occurs a predetermined time later, from an accelerator depression amount, which represents a throttle opening command, and an opening degree (angular position) of the main throttle valve. A failure detector quickly finds, from a deviation between the presumed opening degree of the throttle valve at the predetermined later time and an actual opening degree of the main throttle valve, that the main throttle valve has failed. When a failure occurs, the control of the sub throttle valve is started, making it possible to effect the throttle opening control with improved reliability.

14 Claims, 8 Drawing Sheets

THROTTLE CONTROL APPARATUS FOR ENGINES

BACKGROUND OF THE INVENTION

1. Field of the Invention

This invention relates to a throttle control apparatus attached to an engine and having two, main and sub, throttle actuators. To be more specific, this invention relates to an electronic throttle control apparatus, and particularly relates to an electronic throttle control apparatus for rapidly detecting a failure occurring in a throttle control system by using the modern control theory.

2. Description of the Relates Art

An apparatus for controlling the opening of a throttle valve by electronic control is disclosed in U.S. Pat. No. 4,603,675. This prior art apparatus has a single valve mechanism, and if the valve mechanism becomes unable to move, it follows that the engine increases in the number of revolutions. In order to prevent this problem, this U.S. patent suggests various failure diagnostic methods. However, since in these diagnostic methods, diagnosis is made according to stationary or quasi-stationary signals, these methods are incapable of quick detection of unforeseen accidents. In other words, if a comparison is made between the accelerator position and the throttle valve position, since there is a deviation due to a dynamic delay between the two positions, it is impossible to make a distinction between this deviation and a deviation resulting from a failure, making it impossible to watch out for a failure at all times. Therefore, when an unexpected failure takes place, the failure cannot be detected until an abnormal motion caused by the failure settles down, so that it is relatively difficult to prevent the engine speed from increasing.

SUMMARY OF THE INVENTION

Accordingly, an object of the present invention is to improve the reliability of the throttle opening control apparatus by making it possible to perform the whole or a part of the throttle valve control function by quickly detecting the occurrence of a failure, even if the failure is such that the valve mechanism is unable to move.

The summary of this invention will be described with reference to an embodiment shown in FIG. 1A.

According to the present invention, there is provided a throttle control apparatus for engines comprising: a throttle valve provided in an intake pipe of an engine for controlling an intake air flow; an additional actuator for controlling the operation of the engine; command means for generating a throttle opening command signal indicative of a command value for controlling the intake air flow into the engine; and throttle control system including driving means for electrically driving the throttle valve, detecting means for detecting a position of the throttle valve and producing a throttle position signal, and electronic control means for calculating a control signal from the throttle position signal and the throttle opening command signal and applying the control signal to said driving means, said electronic control means comprising: observer means for outputting a presumed value of the position of the throttle valve when the throttle valve is normally operating and has not failed, the presumed value being obtained in accordance with a mathematical model of said throttle control system; and decision means for comparing the throttle position signal with the presumed value from said observer means and outputting a start command signal to drive said additional actuator when said decision means has decided that said throttle control system has failed.

According to the present invention, observer means, to which modern control theory is applied based on a mathematical model of a main throttle control system centered on the main throttle valve, outputs a presumed value of the opening degree of the main throttle valve when the control system is operating normally. Therefore, if any abnormality arises in the control system, a deviation between the presumed value and the actual opening degree of the main throttle valve increases, and the failure in the control system can be detected quickly and accurately. In other words, when an unpredictable failure occurs in the control system, the above-mentioned deviation occurs immediately in the process of this failure, and according to this deviation, a failure diagnosis is made, so that the failure can be detected quickly. When the failure is detected, the sub throttle valve takes over the main throttle valve to control the intake air amount of the engine. Thus, despite the occurrence of the failure, it is possible to reduce a change in the engine performance.

In this invention, when a failure occurs, the failure is detected in its early stage and the operation to control the intake air into the engine is taken over by the sub throttle valve, sot hat unexpected changes in the air into the engine can be decreased. Thus, it is possible to prevent the deterioration in the performance and stability of the equipment or device driven by the engine. In a car engine, above all, should the main throttle valve becomes out of order, the abnormality cannot be felt during driving, and the driver is prevented from feeling uneasy, so that this invention can contribute a good deal to safe driving.

BRIEF DESCRIPTION OF THE DRAWINGS

FIGS. 4, 5 and 6 are flowcharts for the microcomputer, in which FIG. 4 shows processings for the main throttle controller, FIG. 5 shows processings for the failure detector, and FIG. 6 shows processings for the sub throttle controller; and FIGS. 7A, 7B and 7C are operation characteristics of the apparatus according to the above embodiment, wherein FIG. 7A is a characteristic diagram showing changes in an accelerator position signal forming a throttle opening command signal, FIG. 7B is a characteristic diagram showing changes in throttle position signals representing the opening degrees of the respective throttle valves, and FIG. 7C is a characteristic diagram showing a rise time of a flag representing a sub start command signal.

DESCRIPTION OF THE PREFERRED EMBODIMENTS

An embodiment of this invention will be described with reference to the accompanying drawings.

Figure 1A:
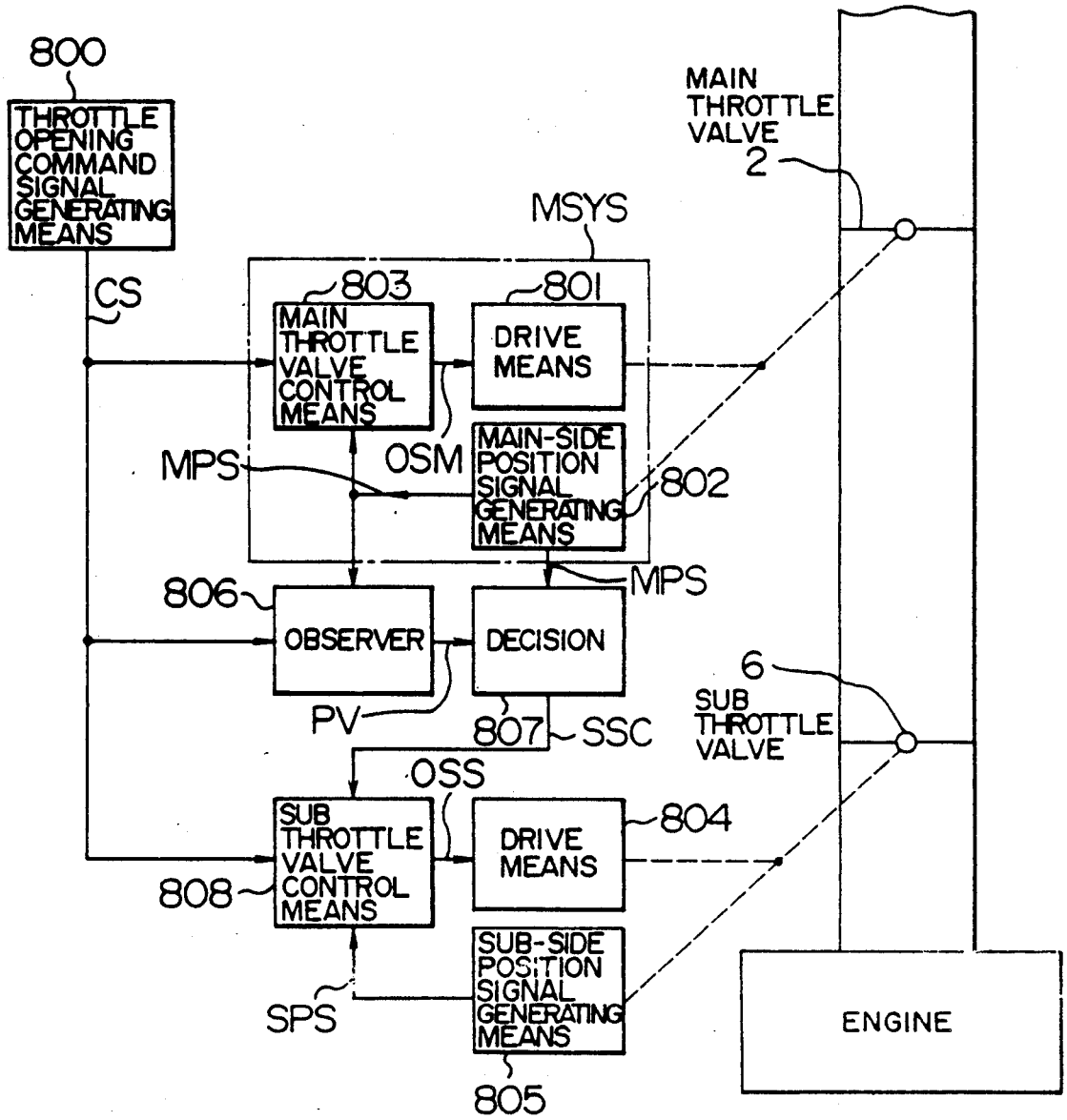
FIG. 1A is a block diagram for explaining the outline of this invention.
Figure 1B:
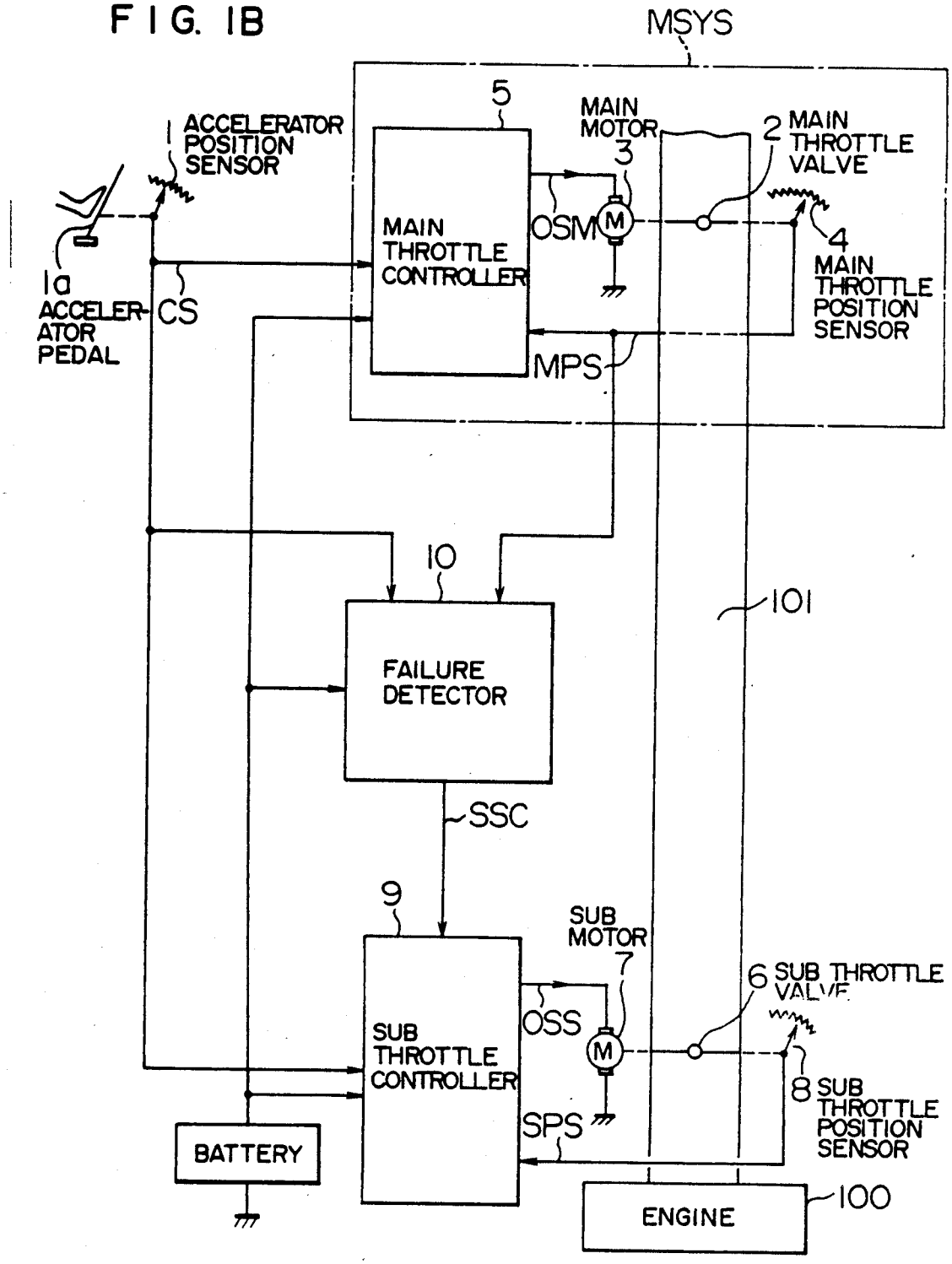
FIG. 1B is a block diagram showing the general construction of an embodiment of this invention.

Referring to FIG. 1B, reference numeral 1 indicates an accelerator position sensor which detects a position of an accelerator pedal 1a operated by a foot of a car driver. A main throttle valve 2, provided in the middle of an intake pipe 101 of an engine 100, is driven by a main motor 3. A main throttle position sensor 4 detects the position of the main throttle valve 2. A main throttle controller 5 drives the main motor 3 according to a control deviation between a target value from the accelerator position sensor 1 and an actual value of the displaced amount of the main throttle valve 2 from the main throttle position sensor 4. The main throttle controller 5 comprises a PID controller (for effecting proportional integral and derivative actions) disclosed in U.S. Pat. No. 4,603,675, for example.

The sub throttle valve 6 is mounted in series with the main throttle valve 2 in the intake pipe 101. In the sub throttle valve 6, there is provided a return spring, not shown, which keeps the sub throttle valve open while the sub throttle valve is not in operation. A sub motor 7 drives the sub throttle valve 6. A sub throttle position sensor 8 detects the displaced amount of the sub throttle valve 6. A sub throttle controller 9 drives the sub motor 7 according to a control deviation between a throttle opening command signal CS for providing a target value generated by the accelerator position sensor 1 and an actual value of the displaced amount of the throttle valve from the sub throttle position sensor 8 while a sub start signal SSC is being output from a failure detector 10. The sub throttle controller comprises a PID controller, for example, as in the main throttle controller 5.

The failure detector 10 detects a failure in the main throttle control system (MSYS) from a target value from the accelerator position sensor 1 and an actual value of the displaced amount of the main throttle valve from the main throttle position sensor 4, and outputs a sub start command signal SSC. (It should be noted that the main throttle controller 5, the failure detector 10 and the sub throttle controller 9 are formed within the microcomputers, and this will be described later.)

Figure 2:
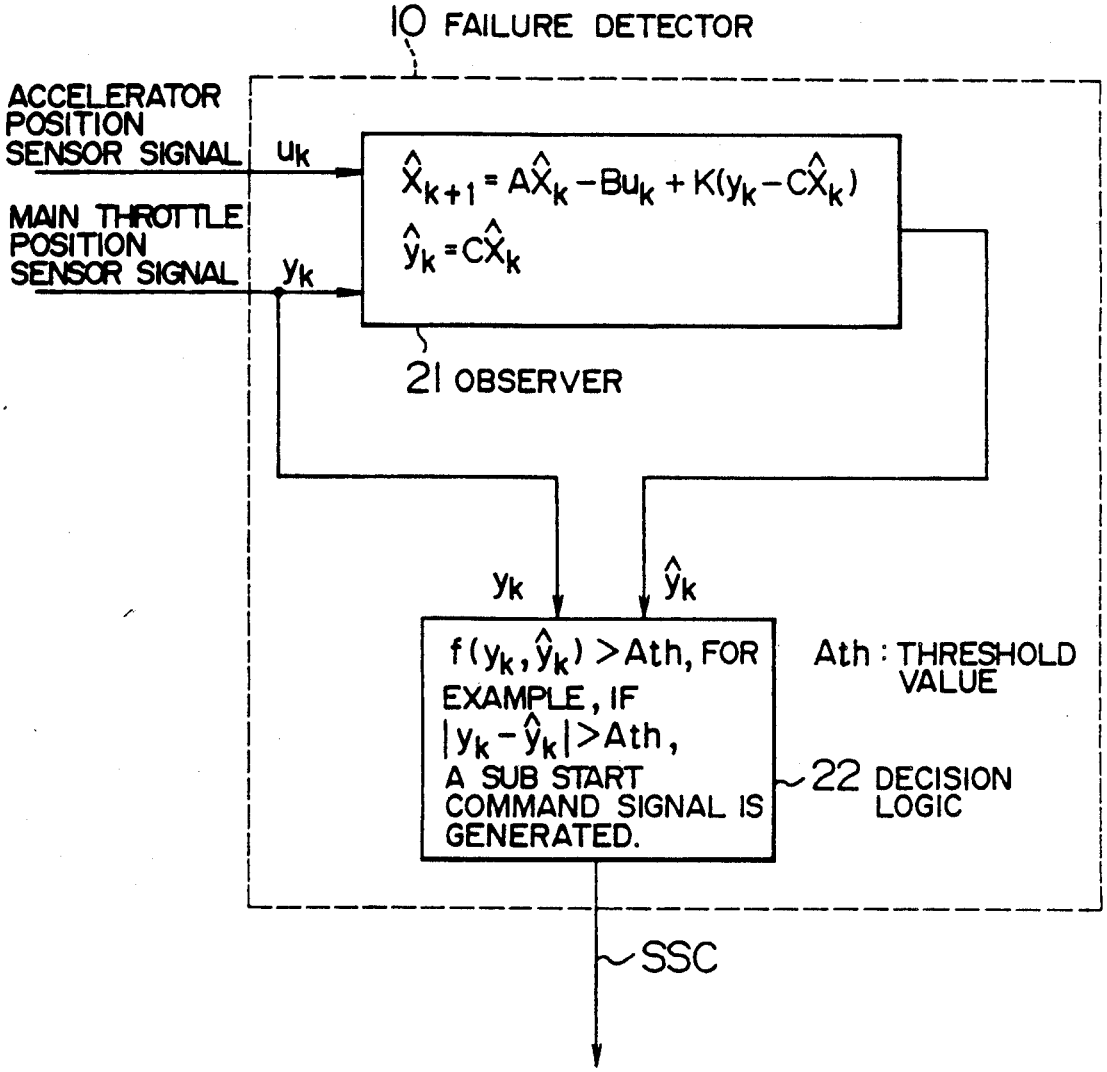
FIG. 2 is a block diagram for explaining a failure detector in the above embodiment.

FIG. 2 shows the construction of the failure detector 10. The failure detector is composed of an observer 21 and a decision logic 22. The observer 21 outputs a presumed value PV (hereafter referred to as $_k$) of the position of the main throttle valve 2 under a normal operating condition from an accelerator position signal $u_k$ (k is a symbol representing a sampling point) identical with a throttle opening command signal CS and a signal $y_k$ identical with a main throttle position signal MPS from the main throttle position sensor 4 in accordance with the mathematical model of the main throttle control system MSYS. The decision logic 22 makes a comparison between the signal $y_k$ from the main throttle position sensor 4 and the presumed value $_k$ of the position of the main throttle valve 2 from the observer 21, and if it has made a decision that the main throttle control system MSYS is out of order, it outputs a sub start signal SSC.

A description will now be made of the design method of the observer 21. It is assumed that the main throttle valve 5 comprises a P (proportional) controller. If the main motor 3 is a DC motor, the equation of the motion for the main motor 3 and the throttle valve 2 can be expressed as follows.

$$V_a = L_a \cdot \frac{di_a}{dt} + R_a \cdot i_a + e_c \tag{1}$$

$$e_c = k_1 \cdot \frac{d\theta}{dt} \tag{2}$$

$$\tau = k_2 \cdot i_a = J \cdot \frac{d^2\theta}{dt^2} + D \cdot \frac{d\theta}{dt} \tag{3}$$

where
$v_a$: Main motor input voltage $[V]$
$i_a$: Main motor armature current $[A]$
$L_a$: Main motor armature inductance $[H]$
$R_a$: Main motor armature resistance $[\Omega]$
$e_c$: Motor counter-electromotive force $(V)$
$\tau$: Torque $[N \cdot m]$
$J$: Moment of inertia $[kg \cdot m^2]$
$D$: Viscosity coefficient $[N \cdot m \cdot s]$
$\theta$: Throttle valve angular position [rad]
$k_1$: Counter-electromotive force coefficient $[V \cdot s]$
$k_2$: Torque coefficient $[N \cdot m/A]$ Substituting Eqs. (2) and (3) into Eq. (1) and disregarding $$L_a \cdot \frac{di_a}{dt}$$

because L is negligibly small, $$\begin{aligned} V_a &= R_a \cdot \frac{J}{K_2} \cdot \frac{d^2\theta}{dt^2} + R_a \cdot \frac{D}{K_2} \cdot \frac{d\theta}{dt} + K_1 \cdot \frac{d\theta}{dt} \\ &= R_a \cdot \frac{J}{K_2} \cdot \ddot{\theta} + \left( R_a \cdot \frac{D}{K_2} + K_1 \right) \cdot \dot{\theta} \end{aligned}$$

By transforming the above equation, we have $$\ddot{\theta} = -\left( \frac{D}{J} + \frac{K_1 \cdot K_2}{R_a \cdot J} \right) \cdot \dot{\theta} + \frac{K_2}{R_a \cdot J} \cdot V_a \tag{4-1}$$

In order to obtain the state equations for the main motor and the throttle valve system, Eq. (4-1) is subjected to replacements as shown in Eq. (4-2) so as to be expressed by matric representation.

$$\left.\begin{aligned} u_{m(t)} &\overset{\Delta}{=} V_a \\ x_{m(t)} &\overset{\Delta}{=} \begin{pmatrix} \theta \\ \dot{\theta} \end{pmatrix} \\ y_{m(t)} &\overset{\Delta}{=} \theta = (0\ 1) \begin{pmatrix} \theta \\ \dot{\theta} \end{pmatrix} \end{aligned}\right\} \tag{4-2}$$

where $u_{m(t)}$ denotes a control input to the main motor 3, $x_{m(t)}$ denotes an angular velocity/angular position of the main motor 3, $y_{m(t)}$ denotes an angular position of the throttle valve 2, and t denotes time.

Therefore, from Eq. (4-1), Eq. (4-3) can be obtained.

$$x_{m(t)} = \begin{pmatrix} \theta \\ \dot{\theta} \end{pmatrix} = \tag{4-3}$$

-continued $$\begin{pmatrix} -\left(\frac{D}{J}+\frac{K_1\cdot K_2}{R_a\cdot J}\right) & 0 \\ 1 & 0 \end{pmatrix}\begin{pmatrix}\theta\\ \theta\end{pmatrix}+\begin{pmatrix}\frac{K_2}{R_a\cdot J}\\ 0\end{pmatrix}u_{m(t)}$$

Replacing the coefficients on the right side and adding an equation representing the relation between $y_{m(t)}$ and $x_{m(t)}$, the state equations for the main motor and throttle valve system can be expressed as:

$$x_{m(t)} = A_m \cdot x_{m(t)} + B_m \cdot u_{m(t)} \quad (5)$$
$$y_{m(t)} = C_m \cdot x_{m(t)} \quad (6)$$

where $$A_m = \begin{pmatrix} -\left(\frac{D}{J}+\frac{K_1\cdot K_2}{R_a\cdot J}\right) & 0 \\ 1 & 0 \end{pmatrix}$$

$$B_m = \begin{pmatrix}\frac{K_2}{R_a\cdot J}\\ 0\end{pmatrix}$$

$$C_m = [0\ 1]$$

Then, by using Eqs. (4-2), (5) and (6), a state equation for the main throttle control system covering a signal $u_{(t)}$ from the accelerator position sensor 1 up to a signal $y_{(t)}$ from the main throttle position sensor 4 is obtained, where $u_{(t)}$ and $y_{(t)}$ are respectively signals from the accelerator position sensor 1 and the main throttle position sensor 4 at time t. It is assumed that the controller 5 is for P (proportional) control.

$$u_{m(t}=K_p(U_{(t)}-y_{(t)}) \quad (7)$$

where K is proportional gain.

Eliminating $u_{m(t)}$ from Eqs. (4), (5) and (6) and setting $$u_{c(t)} \overset{\Delta}{=} u_{(t)},\ x_{c(t)} \overset{\Delta}{=} \begin{pmatrix}\theta\\ \theta\end{pmatrix},\ y_{c(t)} \overset{\Delta}{=} \theta \quad (8)$$

Therefore, $$x_{c(t)} = A_c \cdot x_{c(t)} + B_c \cdot u_{c(t)} \quad (9)$$
$$y_{c(t)} = C_c \cdot x_{c(t)} \quad (10)$$

$$A_c = \begin{pmatrix} -\left(\frac{D}{J}+\frac{K_1K_2}{R_a\cdot J}\right) & -\frac{K_pK_2}{R_a\cdot J} \\ 1 & 0 \end{pmatrix}$$

$$B_c = \begin{pmatrix}\frac{K_pK_2}{R_a\cdot J}\\ 0\end{pmatrix}$$

$$C_c = [0\ 1]$$

Then, from Eqs. (8), (9) and (10), a discrete state equation for the main throttle control system is obtained. That is, by setting $$u_k=u_{(kT)}x_k=x_{c(kT)},\ y_k=y_{(kT)} \quad (11)$$

where T indicates a sampling period and k is the k-th sampling period, we have $$x_{k+1}=A\cdot x_k+B\cdot u_k \quad (12)$$

$$y_k=C_k\cdot x_k \quad (13)$$

$$A \overset{\Delta}{=} e^{ACT} \quad (14)$$

$$B \overset{\Delta}{=} \int_0^T e^{AC(T-\tau)}\cdot B_{(\tau)}d\tau \quad (15)$$

$$C \overset{\Delta}{=} C_c \quad (16)$$

$$e^{ACT} \overset{\Delta}{=} I + AT + \frac{A^2T^2}{2!} + \ldots \quad (17)$$

The derivation of Eqs. (14) and (15) is described in "Digital Control of Dynamic Systems, G.F. Franklin and J.D. Powell, Addison-Wesley Publishing Company, Mass., 1981, pp. 131-139" (paper No. 1), for example.

In the foregoing, a mathematical model of the main throttle control system MSYS expressed by the state equations has been discussed.

By using actual values as shown below, $$R_a = 5.8\ [\Omega]$$
$$L_a = 0\ [H]$$
$$J = 1.3\times 10^{-5}\ [\mathrm{kg}\cdot \mathrm{m}^2]$$
$$D = 2.6\times 10^{-5}\ [N\cdot ms]$$
$$K_1 = 0.026\ [V\cdot s]$$
$$K_2 = 2.5\times 10^{-2}\ [N\cdot m/A]$$
$$K_p = 0.1$$

the parameters are obtained.

$$A_c = \begin{pmatrix} -10.6 & -33.1 \\ 1 & 0 \end{pmatrix} \quad (18)$$

$$B_c = \begin{pmatrix}33.1\\ 0\end{pmatrix} \quad (19)$$

$$C_c = [0\ 1] \quad (20)$$

Supposing the sampling period T=5 ms, $$A = \begin{pmatrix} 0.948 & -0.1612 \\ 0.0049 & 0.9996 \end{pmatrix} \quad (21)$$

$$B = \begin{pmatrix}0.1612\\ 0.0004\end{pmatrix} \quad (22)$$

$$C = [0\ 1] \quad (23)$$

Next, the parameters of the observer of the main throttle control system, as expressed by Eqs. (12) and (13), are derived. A design method and properties are described in detail in "Linear Optimal Control Systems, H. Kwakernaak and R. Sivan, Wiley-Interscience, N.Y., 1972, pp. 522–536", for example, Therefore, only the result will be shown below.

If the observer is represented by the following equations, $$_{k+1}=A\ _k+Bu_k+k(y_k-C\ _k) \quad (24)$$

$$_k=C\ _k \quad (25)$$

where $_k$ is a presumed value of $x_k$, $_k$ is a presumed value of $y_k$, and K is the freedback gain of an output error, the designing of the observer is to find the gain K. Here, an observer is designed by using the pole placement method such that the eigen value of the observer {the eigen value of (A−KC)} is in the order of the square (to have a double convergence rate in a continuous system) of the eigen value of the main throttle control system (the eigen value of A). The pole placement method is described on pages 198 through 201 of paper No. 2.

First of all, the eigen values of A (designated as $\lambda_1$ and $\lambda_2$) are obtained as $$\lambda_1=0.9738+i0.0109$$

$$\lambda_2=0.9737-i0.0109$$

Supposing that the eigen value of the observer is about the square of the absolute value of $\lambda_1$, the following values are selected.

$$\lambda_{01}=0.95$$

$$\lambda_{01}=0.90$$

Selecting the gain K by the pole placement method, we have $$K=\begin{pmatrix}-0.1811\\0.0976\end{pmatrix}$$

The parameters A, B, C and K of the observer have thus been derived.

The configuration method of the decision logic 22 will be described in the following. In this embodiment, when an absolute value of a deviation between the actual value $y_k$ of the main throttle valve position and the output $_k$ of the observer is larger than the threshold value $A_{th}$, a decision is made that the main throttle side has failed. More specifically, as shown in FIG. 2, the decision logic gives a decision "if $|y_k-\ _k|>A_{th}$, a sub start command signal is output". By setting the threshold value $A_{th}$ at about three times the standard deviation of the difference between $y_k$ and $_k$ at the time when the main throttle valve is operating normally, a decision logic, which is less susceptible to effects of an observer noise, can be composed.

Figure 3:
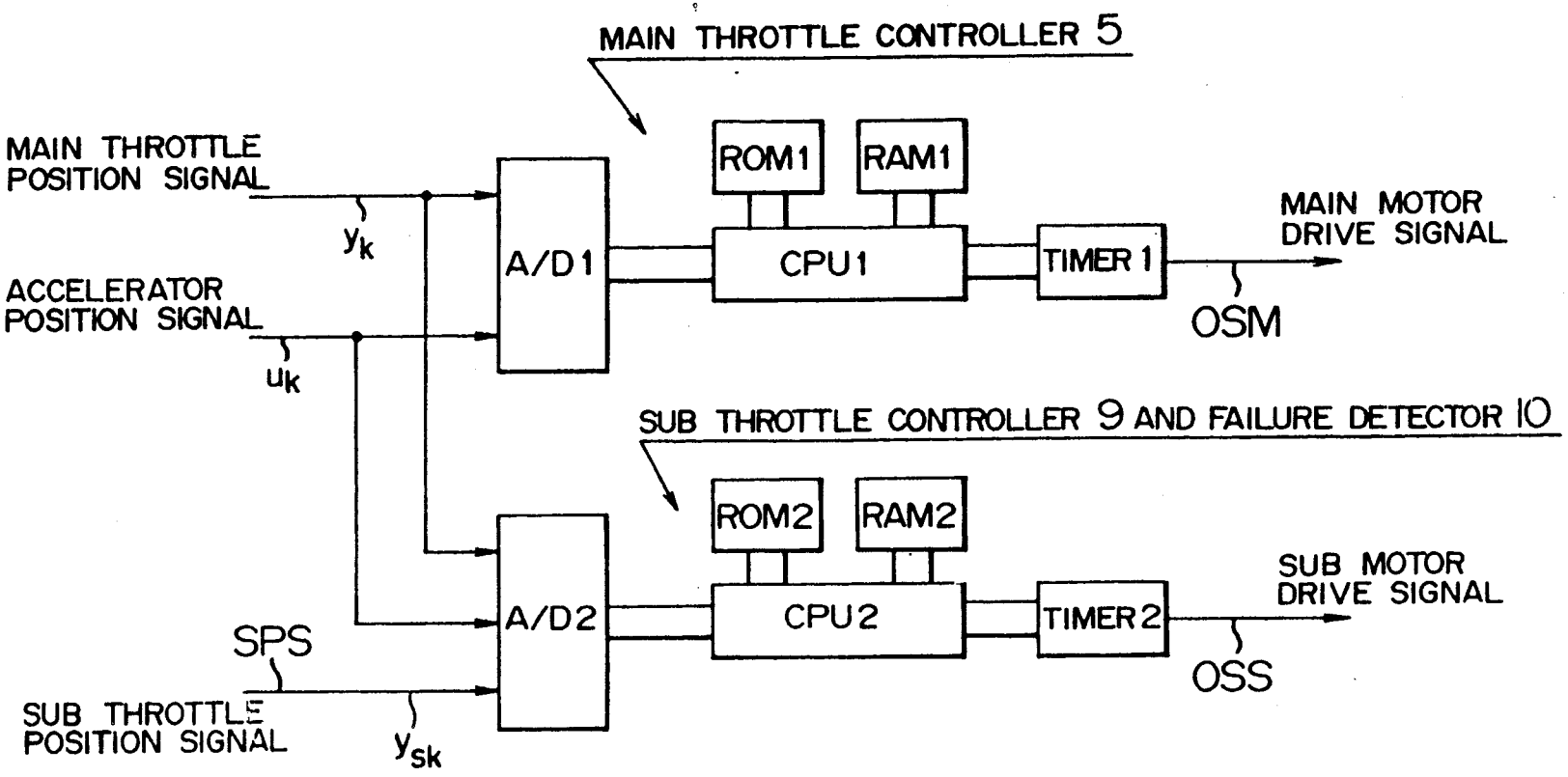
FIG. 3 is a block connection diagram showing a concrete composition of the above embodiment in which the main throttle controller, the sub throttle controller and the failure detector are composed by using two microcomputers.

The main throttle controller 5, the sub throttle controller 9 and the failure detector 10 are configured by microcomputers as shown in FIG. 3. FIG. 3 is a block diagram showing the composition of the main throttle controller 5, the sub throttle controller 9 and the failure detector 10, shown in FIG. 1B. In FIG. 3, the throttle opening control apparatus according to this embodiment comprises two CPU's, and reference numeral 1 denotes a CPU (a central processing unit as the heart of a microcomputer), which is arranged to function as the main throttle controller 5, while CPU 2 is arranged to function as the sub throttle controller 9 and also as the failure detector 10. Since different functions are assigned to the separate CPU's, a failure in one section of the apparatus is less likely to affect the other. Each CPU has connected thereto an A/D converter (A/D 1 or A/D 2), a read only memory ROM (ROM 1 or ROM 2), a random access memory RAM (RAM 1 or RAM 2) and a timer (timer 1 or timer 2), thus forming a separate microcomputer. The A/D converter A/D 1 accepts a main throttle position signal $y_k$ and an accelerator position signal $u_k$, while A/D 2 accepts a sub throttle position signal SPS in addition to the above-mentioned two signals. Timer 1 outputs a PWM signal OSM to drive the main motor 3, while timer 2 outputs a PWM signal OSS to drive the sub motor 7.

Figure 4:
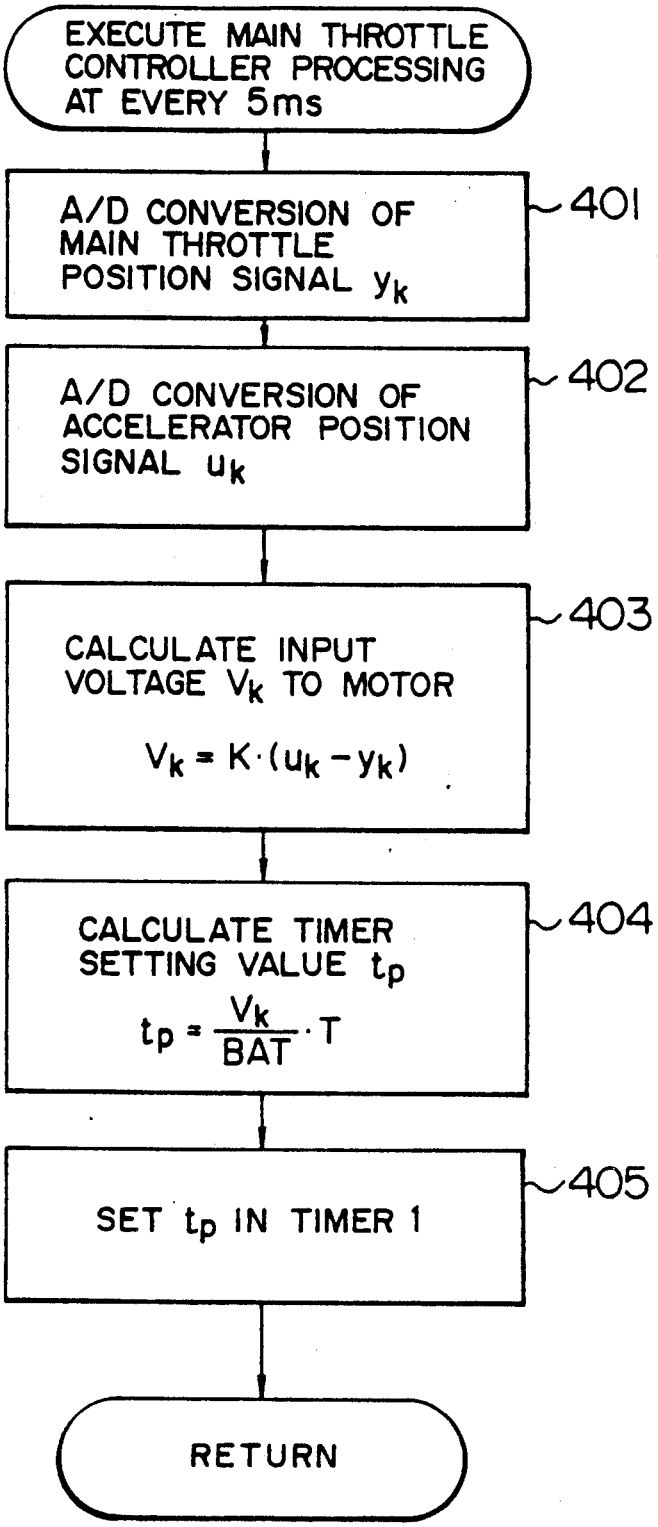
Figure 5:
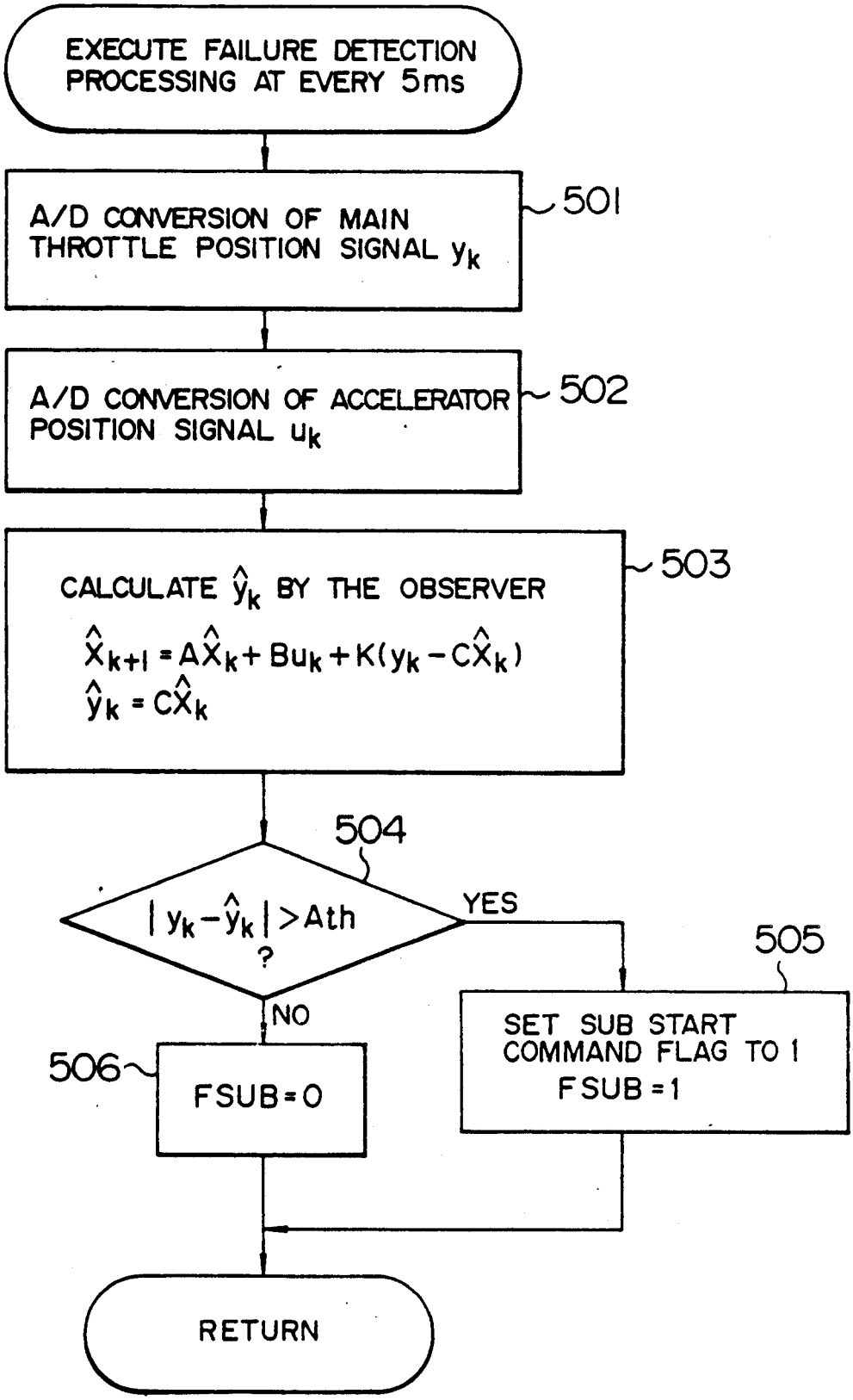

The operating processings of each CPU will be described with reference to subroutines shown in FIGS. 4, 5 and 6. FIG. 4 shows the processing steps of the main throttle controller 5 of FIG. 1B by CPU 1 of FIG. 3. This processing is executed at every 5-ms sampling period. To begin with, at step 401, a main throttle position signal $y_k$ is converted from an analog form into a digital form, and at step 402, an accelerator position signal $u_k$ from an analog form into a digital form. Then, at step 403, input voltage $V_k$ to the main motor is calculated according to the proportional control law $V_k=K\cdot(u_k-y_k)$ where K is a proportional gain. At step 404, a timer setting value $t_p$, at which the input voltage $V_k$ to the main motor is modulated by pulse width modulation, is calculated. The timer setting value is data showing an ON time of a PWM signal by which the throttle valve is driven. The data $t_p$ is inputted into the PWM driver, that is, the timer, and the timer gives a pulse-train signal to the motor.

$$t_p=\frac{V_k}{BAT}\cdot T$$

where *BAT*: Battery voltage
*T*: Sampling period

Finally, at step 405, the timer setting value $t_p$ is set in timer 1, and the processing returns to the main routine. FIG. 5 shows the failure detection processing steps of the failure detector 10 of FIG. 1B conducted by CPU 2. This processing is executed at every 5-ms sampling period. At the first step 501, a main throttle position signal $y_k$ is converted from an analog form into a digital form. At step 502, an accelerator position signal $u_k$ is converted from an analog form into a digital form. At step 503, a presumed value $y_k$ of the main throttle position is calculated by the observer defined by Eqs. (24) and (25). At step 504, the absolute value of a deviation between $y_k$ and $y_k$ is compared with a threshold value $A_{th}$ by the decision logic. If the absolute value of the deviation is greater than the threshold value, a sub start command flag FSUB is set to 1 at step 505. If not, the flag is set at 0 at step 506, and the processing returns to the main routine.

Figure 6:
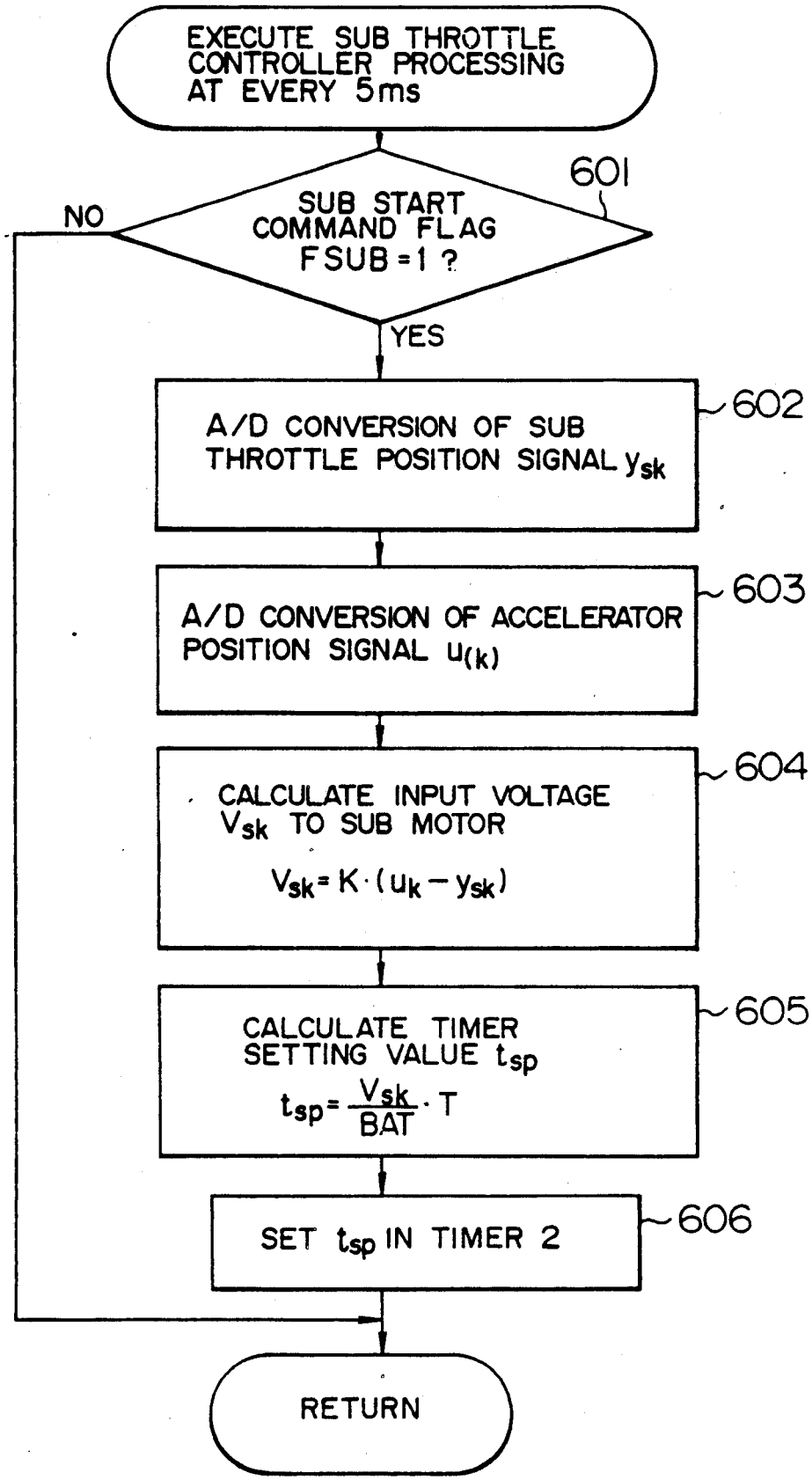

FIG. 6 shows the processing steps of the sub throttle controller 9 shown in FIG. 1B conducted by CPU 2 of FIG. 3. This processing is executed at every 5-ms sampling period. At the first step 601, a check is made of the sub start command flag FSUB set at step 505 of FIG. 5, and if the FSUB is 0, the processing returns to the main routine. If the FSUB is 1, the execution of the processing steps of the sub throttle controller 9 shown in FIG.

1B is started. The subsequent steps 603, 604, 605, and 606 are executed in a manner similar to the processing steps of the main throttle controller 5 shown in FIG. 4, and hence the duplication in description will be avoided.

Figure 7A:
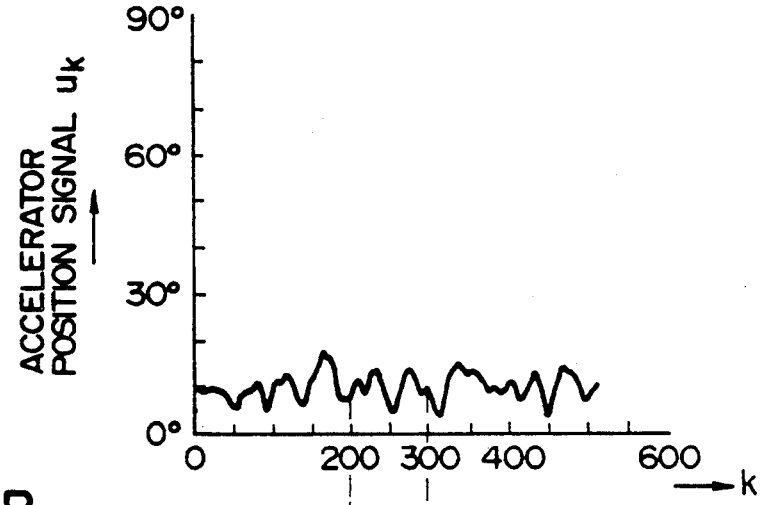
Figure 7B:
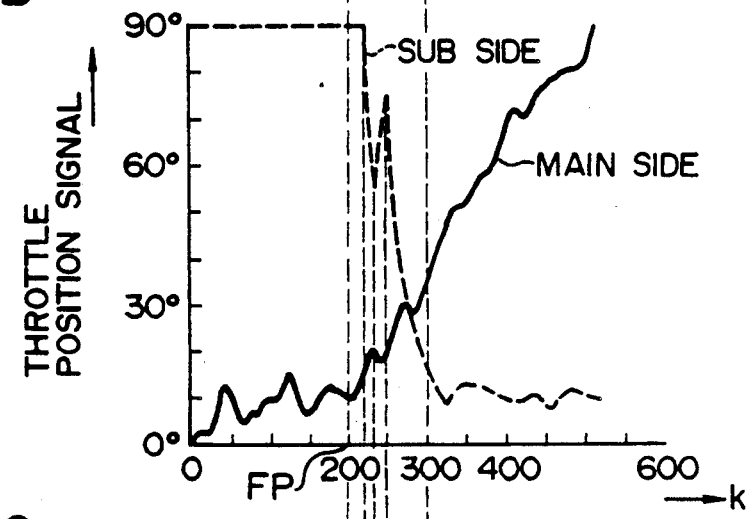
Figure 7C:
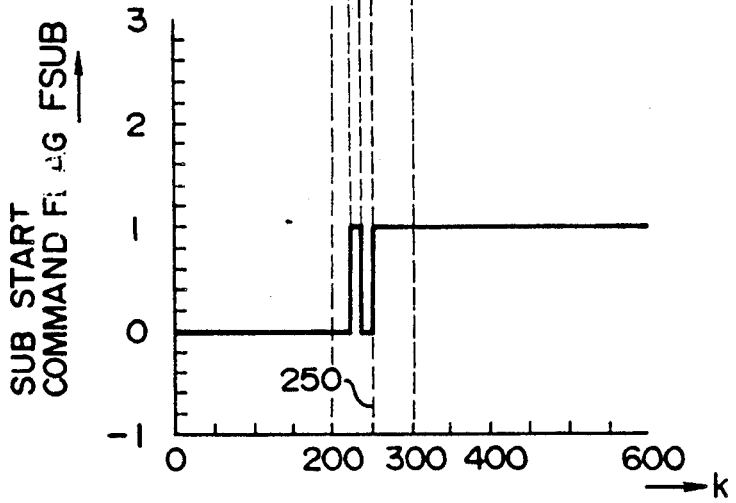

FIG. 7 shows the result of an experiment conducted according to this embodiment which has been described. FIG. 7A is a characteristic diagram of changes in signals (CS or $u_k$) from the accelerator position sensor 1 of FIG. 1B. FIG. 7B is a characteristic diagram of changes in signals from the main throttle position sensor 4 and sub throttle position sensor 8. FIG. 7C shows rise points of the sub start command flag set at steps 505 and 506 of FIG. 5. In FIGS. 7A to 7C, the horizontal axis represents the sampling point k. In the experiment, a failure was caused to occur in the main throttle control system MSYS at a time point of k=200 (at FP indicated in FIG. 7B). On the other hand, as shown in FIG. 7C, the failure detector 10 sets the sub start command to 1 at a time point k=250 and outputs a sub throttle start command signal. Upon receiving this sub start command signal, the sub control system came to follow an accelerator position sensor signal shown in FIG. 7A at a time point k=300. Thus, according to this embodiment, it is possible to realize a throttle valve opening control apparatus which includes a backup function by a sub throttle valve 6 with a good response and which can restore to a normal operating condition in a total of 0.5 sec (100 sampling times) from the occurrence of a failure that the main throttle valve opens by itself.

In the foregoing embodiment, the decision logic shown in FIG. 2 is arranged to output a sub start command signal when the absolute value of a deviation between the main throttle position sensor signal $y_k$ and an output signal $_k$ of the observer 21 is greater than a threshold value $A_{th}$. Hysterisis may be provided for threshold value $A_{th}$ between when the main throttle valve is operating normally and when the main throttle valve is out of order.

Further in the foregoing embodiment, as shown in FIG. 2, a throttle opening command signal CS, which is inputted into the observer 21, is an accelerator position sensor signal $u_k$. However, a failure in the main throttle control system can be detected even if the input signal to the observer 21 is a throttle opening command signal from an existing device such as a cruise control device which keeps the vehicle running speed at a predetermined value, or a traction control device for preventing a wheel slip from occurring at the time of start of a vehicle.

We claim:

1. A throttle control apparatus for engines comprising:

a throttle valve provided in an intake pipe of, an engine for controlling an intake air flow;

an additional actuator for controlling the operation of the engine;

command means for generating a throttle opening command signal indicative of a command value for controlling the intake air flow into the engine; and throttle control system including driving means for electrically driving the throttle valve, detecting means for detecting a position of the throttle valve and producing a throttle position signal, and electronic control means for calculating a control signal from the throttle position signal and the throttle opening command signal and applying the control signal to said driving means, said electronic control means comprising:

observer means for outputting a presumed value of the position of the throttle valve when the throttle valve is normally operating and has not failed, the presumed value being obtained in accordance with a mathematical model of said throttle control system; and decision means for comparing the throttle position signal with the presumed value from said observer means and outputting a start command signal to drive said additional actuator when said decision means has decided that said throttle control system has failed.

2. A throttle control apparatus for engines according to claim 1, wherein said decision means outputs a start command signal to start said additional actuator when the absolute value of a difference between the presumed value of the opening of the throttle valve and the throttle position signal exceeds a predetermined value.

3. A throttle control apparatus for engines according to claim 1, wherein said observer means is formed on the basis of the following state equation.

$$_{k+1}=A\cdot\ _k+B\cdot u_k+K\cdot(y_y-C\cdot\ _k)$$

$$_k=C\cdot\ _k$$

where $x_k$ and $y_k$ respectively denote measured values of a position signal of said driving means and an output signal of said detecting means at a sampling time point k; $_k$ and $_k$ respectively denote average values of said signals $x_k$ and $y_k$ at a sampling time point k; $u_k$ denotes the throttle opening command signal; A, B and C denote coefficients; and K denotes a feedback gain of an output error of said observer means.

4. A throttle control apparatus for engines according to claim 1, wherein said decision means is arranged to make a decision according to a decision logical expression $f(y_k,\ _k)>A_{th}$ composed of a decision function, including a case of an expression $|y_k-\ _k|$, and a decision threshold value $A_{th}$, where $y_k$ and $y_k$ respectively denote a measured value and an average value of the output signal of said detecting means at a sampling time point k, and wherein said decision means decides that said throttle control system has failed when said decision logical expression is satisfied, and outputs a start command signal to start said additional actuator.

5. A throttle control apparatus for engines according to claim 1, wherein said electronic control means is arranged to perform at every 5 ms arithmetic operations in accordance with a subroutine for processing steps comprising:

a step of performing A/D conversion of a measured value of an output signal of said throttle position signal generating means at a sampling time point k;

a step of performing A/D conversion of the throttle opening command signal at a sampling time point k;

a step of calculating a voltage $V_k$ to be applied to said driving means through a timer 1 according to a calculation formula $V_k=K\cdot(u_k-y_k)$ where K is a proportional gain;

a step of calculating a setting time $t_p$ to be set in said timer 1 for voltage application to said driving means according to a calculation formula $$t_p = \frac{V_k}{BAT} \cdot T$$

where BAT is a voltage of a battery and T is a sampling period; and a step of setting a calculated value of said setting time $t_p$ in said timer 1.

6. A throttle control apparatus for engines having two throttle valves of main and sub throttle valves disposed in the middle of an intake pipe of an engine for controlling an amount of intake air into the engine by using the sub throttle valve when the main throttle valve has failed, comprising:

means for generating a throttle opening command signal indicative of a command value for controlling the intake air amount into the engine;

means for driving the main throttle valve provided in the middle of the intake pipe of the engine;

means for detecting a position of the main throttle valve and producing a main throttle position signal;

main throttle valve control means for calculating a control signal from the main throttle position signal and the throttle opening command signal and applying the control signal to said main throttle valve drive means;

means for driving said sub throttle valve which is mounted in series with said main throttle valve in the intake pipe and stays in a normally open state while said sub throttle valve is not in operation;

means for detecting a position of said sub throttle valve and producing a sub throttle position signal;

observer means for outputting a presumed value of the opening of said main throttle valve, when said main throttle valve is normally operating and has not failed, which presumed value is obtained from the throttle opening command signal and the main throttle position signal in accordance with a mathematical model of a main throttle control system, said main throttle control system including said means for driving the main throttle valve, said means for producing the main throttle position signal and said main throttle valve control means;

decision means for comparing the main throttle position signal with the presumed value from said observer and outputting a sub start command signal when said decision means has decided that said main throttle control system has failed; and sub throttle valve control means for calculating a control signal from the throttle opening command signal and the sub throttle position signal when a sub start command signal is outputted from said decision means, and applying the calculated control signal to said means for driving the sub throttle valve.

7. A throttle control apparatus for engines according to claim 6, wherein said main throttle valve control means is formed by a first microcomputer, and wherein said sub throttle valve control means, said observer means and said decision means are formed by a second microcomputer.

8. A throttle control apparatus for engines comprising:

an accelerator position sensor for detecting an operated amount of an accelerator to control an amount of intake air into an engine and outputting a signal representing a target value;

a main throttle valve provided in the middle of an intake pipe of the engine;

a main motor for driving said main throttle valve;

a main throttle position sensor for detecting an amount of displacement of said main throttle valve;

a main throttle controller for driving said main throttle valve by means of said main motor on the basis of a control deviation between the target value from said accelerator position sensor and the displacement amount detected by said main throttle position sensor;

a sub throttle valve mounted in series with said main throttle valve in said intake pipe and staying in a normally open state when said sub throttle valve is not in operation;

a sub motor for driving said sub throttle valve;

a sub throttle position sensor for detecting the displacement amount of said sub throttle valve;

an arithmetic section for detecting a failure occurring in a main throttle control system, which includes at least said main throttle controller, said main motor, said main throttle valve and said main throttle position sensor, from the target value from said accelerator position sensor and the displacement amount from said main throttle position sensor and outputting a sub start command signal, said arithmetic section comprising: a first arithmetic unit for calculating a presumed value of the position of said main throttle valve in a normal condition in accordance with said target value from said accelerator position sensor and the displacement amount from said main throttle position sensor; and a second arithmetic unit for comparing the displacement amount from said main throttle position sensor with the presumed value from said first arithmetic unit and outputting the sub start command signal when said second arithmetic unit decides that said main throttle control system has failed; and a sub throttle controller for driving said sub motor on the basis of a control deviation between the target value from said accelerator position sensor and the displacement amount from said sub throttle position sensor when the sub start command signal is outputted from said arithmetic section.

9. A throttle control apparatus for engines according to claim 8, wherein said first arithmetic unit forms said observer means for calculating a presumed value of the opening position of said main throttle valve in a normal condition in accordance with a mathematical model of said main throttle control system.

10. A throttle control apparatus for engines according to claim 9, wherein said observer means is formed on the basis of the following state equation.

$$_{k+1} = A \cdot {}_k + B \cdot u_k + K \cdot (y_k - C \cdot {}_k)$$

$$_k = C \cdot {}_k$$

where $x_k$ and $y_k$ respectively denote measured values of the motor position signal and the main throttle position sensor signal at a sampling time point k, $_k$ and $_k$ respectively denote average values of said signals $x_k$ and $y_k$ at a sampling time point k, $u_k$ denotes the accelerator position sensor signal, A, B and C denote coefficients, and K denotes a feedback gain of an output error of said observer means.

11. A throttle control apparatus for engines according to claim 8, wherein said second arithmetic unit includes decision means for inputting the displacement amount from said main throttle position sensor and the presumed value of the position of said main throttle valve in a normal condition from said first arithmetic unit, comparing both input data with each other, and deciding whether or not said main throttle control system has failed.

12. A throttle control apparatus for engines according to claim 11, wherein said decision means is arranged to make a decision on the basis of a decision logical expression composed of a decision function $f(y_k, \ _k)$, including a case of an expression $|y_k - \ _k|$, and a decision threshold value $A_{th}$, to decide that said main throttle control system has failed when the above decision logical expression is satisfied, and to output said sub start command signal.

13. A throttle control apparatus for engines according to claim 8, wherein said main throttle controller is arranged to perform at every 5 ms arithmetic operations in accordance with a subroutine for processing steps of said main throttle controller comprising:

a step of performing A/D conversion of a measured value of an output signal of said throttle position signal generating means at a sampling time point k;

a step of performing A/D conversion of the throttle opening command signal at a sampling time point k;

a step of calculating a voltage $V_k$ to be applied to said main motor through a timer 1 according to a calculation formula $V_k = K \cdot (u_k - y_k)$ where K is a proportional gain;

a step of calculating a setting time $t_p$ to be set in said timer 1 for voltage application to said main motor according to a calculation formula $t_p =$ $$\frac{V_k}{BAT} \cdot T$$

where BAT is a voltage of a battery and T is a sampling period; and a step of setting a calculated value of said setting time t in said timer 1.

14. A throttle control apparatus for engines according to claim 8, wherein said sub throttle controller is arranged to perform at every 5 ms arithmetic operations in accordance with a subroutine for processing steps of said sub throttle controller comprising:

a step of deciding whether a sub start command flag, which indicates whether or not the sub start command signal has been outputted, is "1" or not, retuning processing of a main routine when the sub start command signal is not "1", and proceeding to a next step when the sub start command signal is "1";

a step of performing A/D conversion of a sub throttle position sensor signal at a sampling time point k;

a step of performing A/D conversion of an accelerator position sensor signal at a sampling time point k;

a step of calculating a voltage $V_{sk}$ to be applied to said sub motor through a timer 2 according to a calculation formula $Vsk = K \cdot (u_k - y_{sk})$ where K is a proportional gain;

a step of calculating a setting time $t_{sp}$ to be set in said timer 2 for voltage application to said sub motor according to a calculation formula $t_{sp} =$ $$\frac{V_{sk}}{BAT} \cdot T$$

where BAT is a voltage of a battery and T is a sampling period; and a step of setting a calculated value of said setting time $t_{sp}$ in said timer 2.

* * * * *